US008015768B2

(12) United States Patent
Frejowski

(10) Patent No.: US 8,015,768 B2
(45) Date of Patent: Sep. 13, 2011

(54) INSULATION PANEL

(76) Inventor: Fryderyk Jerzy Frejowski, Tychy (PL)

( * ) Notice: Subject to any disclaimer, the term of this patent is extended or adjusted under 35 U.S.C. 154(b) by 314 days.

(21) Appl. No.: 12/219,128

(22) Filed: Jul. 16, 2008

(65) Prior Publication Data

US 2009/0205288 A1 Aug. 20, 2009

(30) Foreign Application Priority Data

Feb. 18, 2008 (PL) ..... 117292

(51) Int. Cl.
*E04F 13/08* (2006.01)

(52) U.S. Cl. ..... 52/309.4; 52/385; 52/506.05; 428/156; 428/137; 428/167

(58) Field of Classification Search ..... 52/384, 52/385, 387, 404.1, 407.4, 404.2, 404.4, 52/506.02, 309.4, 410, 506.05, 511, 506.01, 52/591.4, 315, 794.1; 428/158–160, 167, 428/131, 137
See application file for complete search history.

(56) References Cited

U.S. PATENT DOCUMENTS

| | | | | | |
|---|---|---|---|---|---|
| 421,742 | A | * | 2/1890 | Marsh | 52/387 |
| 1,836,964 | A | * | 12/1931 | Grigsby et al. | 52/387 |
| 2,035,902 | A | * | 3/1936 | MacLeod | 52/410 |
| 2,114,710 | A | * | 4/1938 | Holcomb | 52/387 |
| 3,212,861 | A | * | 10/1965 | Whitesides | 52/410 |
| 3,715,417 | A | * | 2/1973 | Pope | 264/46.5 |
| 3,878,658 | A | * | 4/1975 | Davis et al. | 52/410 |
| 4,324,605 | A | * | 4/1982 | Bethea | 156/247 |
| 4,361,997 | A | * | 12/1982 | DeCaro | 52/512 |
| 4,432,177 | A | * | 2/1984 | Amesso et al. | 52/309.17 |
| 4,522,855 | A | * | 6/1985 | Bethea | 428/49 |
| 5,056,281 | A | * | 10/1991 | McCarthy | 52/169.5 |
| 5,205,091 | A | * | 4/1993 | Brown | 52/126.6 |
| 5,412,917 | A | * | 5/1995 | Shelton | 52/403.1 |
| 5,428,935 | A | * | 7/1995 | Mitchell | 52/698 |
| 5,609,000 | A | * | 3/1997 | Niese | 52/480 |
| 5,709,058 | A | * | 1/1998 | Shaw | 52/404.1 |
| 5,806,270 | A | * | 9/1998 | Solano et al. | 52/747.11 |

(Continued)

FOREIGN PATENT DOCUMENTS

EP 1496171 A2 * 1/2005

(Continued)

OTHER PUBLICATIONS

EP 1496171 A2—Machine Translation.*

*Primary Examiner* — Robert J Canfield
*Assistant Examiner* — Brent W Herring
(74) *Attorney, Agent, or Firm* — William J. Sapone; Coleman Sudol Sapone P.C.

(57) ABSTRACT

A subject of the invention is the lining panel with insulation. The panel is a thin, cuboidal block made of a porous insulation material with internal protruding elements on two adjacent sides and frontal undercuts on the remaining sides, having parallel horizontal protruding elements on the external surface, where the distance between the two adjacent protruding elements is a standardised width of ceramic tiles and it has the developed surfaces between the protruding elements (4.) and round pressed forms evenly distributed in rows (5.), with dimensions corresponding to edges of expansion bolts, and in the centres thereof the forms contain deeper aligning pressed forms (6). The panel is made of the expanded polyurethane resin or of a rigid structural foam having an increased hardness.

4 Claims, 1 Drawing Sheet

U.S. PATENT DOCUMENTS

| | | | | |
|---|---|---|---|---|
| 5,842,316 | A * | 12/1998 | Keiper | 52/410 |
| 6,247,874 | B1 * | 6/2001 | Hu | 405/43 |
| RE37,615 | E * | 4/2002 | Niese | 52/480 |
| 6,442,905 | B1 * | 9/2002 | Weinstein | 52/34 |
| 6,455,127 | B1 * | 9/2002 | Valtanen | 428/137 |
| 6,694,691 | B2 * | 2/2004 | Ku | 52/403.1 |
| 7,442,423 | B2 * | 10/2008 | Miller | 428/57 |
| 7,464,658 | B2 * | 12/2008 | Dhellemmes et al. | 114/74 A |
| 7,487,622 | B2 * | 2/2009 | Wang | 52/384 |
| 7,651,757 | B2 * | 1/2010 | Jones et al. | 428/172 |
| 7,694,480 | B2 * | 4/2010 | Niese et al. | 52/403.1 |
| 2003/0024192 | A1 * | 2/2003 | Spargur | 52/309.4 |
| 2005/0076611 | A1 * | 4/2005 | Crawford | 52/782.1 |
| 2005/0247018 | A1 * | 11/2005 | Johnson et al. | 52/749.11 |
| 2006/0096209 | A1 * | 5/2006 | Dhellemmes et al. | 52/405.3 |
| 2008/0110123 | A1 * | 5/2008 | Oberoi et al. | 52/520 |

FOREIGN PATENT DOCUMENTS

| | | | |
|---|---|---|---|
| JP | 2006336449 | A * | 12/2006 |
| PL | WU-115930 | | 2/2006 |
| PL | 63805 | Y1 * | 6/2008 |

* cited by examiner

INSULATION PANEL

BACKGROUND OF THE INVENTION

The object of the invention is a lining panel with insulation especially adapted for fixing ceramic cladding.

SUMMARY OF THE INVENTION

So far, the ceramic cladding has been fixed as follows. The wall surfaces are covered with mortar, and then ceramic tiles are set with special spacers to keep the equal distances between neighbouring tiles. With the mortar hardened, the filling material is introduced into the distances between the tiles.

Also, prefabricated lining panels are used in the construction industry. Ceramic cladding is fixed to their surfaces. The traditional lining panels have internal protruding elements on two adjacent sides, and on the remaining sides frontal undercuts which allow for tuck-fixing. The panels are typically made as covered plaster cardboard panels or reinforced concrete panels. They are fixed as a whole to the building surfaces. Therefore, their transport and fixing is inconvenient since their surfaces can easily be damaged. Their decorative and insulating properties do not combine well. Due to the temperature differences, they require additional insulation of the target base. Most frequently, the base is insulated by fixing additional insulating panels, in particular panels made of expanded polystyrene with a higher strength. Then the base is covered with a mesh and the ceramic tiles are set with an adhesive mortar.

Following the application of the invention, application no. 115930, the lining panel with insulation is known. The panel is a thin, cuboidal block made of a porous insulation material with internal protruding elements on two adjacent sides and frontal undercuts on the remaining sides, and with parallel horizontal protruding elements on the external surface. Yet, the distance between the two adjacent protruding elements is a standardised width in ceramic tiles. The panel according the invention is made of an expanded polyurethane resin in a form of a rigid structural foam with a higher resistance to weather conditions, or with an expanded polystyrene with a higher hardness. The panel is fixed to the wall as follows. First, board laths are fixed to the wall. Then, an adhesive mortar is put on the internal surface of the panel according the model and pressed to the wall. Finally, the panel is additionally fixed to the wall with expansion bolts.

Next, an adhesive mortar is placed with squeegees onto the strips of the surface between the protruding elements. The ceramic tiles, for example, clinker tiles, are set onto the mortar. With the adhesive mortar hardened, the joints between the tiles are filled in with a joint mortar. While fixing the traditional panel, it is important due insulation durability to evenly place the expansion bolts. In traditional panels, it is necessary to measure the distances, which is frequently done to the fitter's discretion. Moreover, adhesive properties of the hardened mortar to the smooth surface of the expanded plastic between the protruding elements are not satisfactory. The structure of the lining panel with insulation according the model excludes these disadvantages.

The lining panel with insulation according the model is a thin, cuboidal block made of a porous insulation material with internal protruding elements on two adjacent sides and frontal undercuts on the remaining sides, and with parallel protruding elements on the external surface. Yet, the distances between the two adjacent protruding elements are a standardised width in ceramic tiles. The distances are developed and contain round pressed forms evenly distributed in rows, with a width and thickness corresponding to edges of the expansion bolts. In the centre of the edges, there are deeper aligning pressed forms. The developed surfaces between adjacent protruding elements have rows of parallel multidirectional grooves.

Round pressed forms between the protruding elements indicate the location of expansion bolt edges. This allows for recessing them into the panel. Darkened spots on the panel in places of aligning pressed forms indicate where to place the bolt, thus facilitating their fixing. Fixing the expansion bolts in pressed spots leads to an even adhesion of the panel according the model to the base and to obtaining an even surface for ceramic tiles. The developed surface between the protruding elements improves adhesion of the adhesive mortar to the base.

Insulating panels according to the invention can be made of expanded plastic, for example, of expanded olefin plastic or polyurethanes.

BRIEF DESCRIPTION OF THE DRAWINGS

The invention has been shown in the appended drawing.

DETAILED DESCRIPTION OF THE INVENTION

Figure 2:
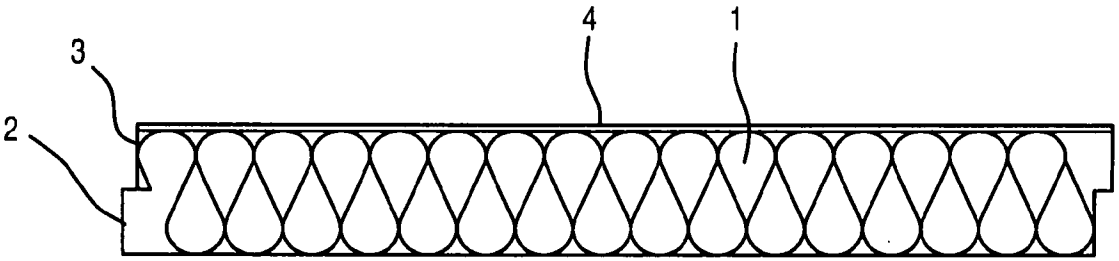
FIG. 2 shows the panel with longitudinal section.
Figure 1:
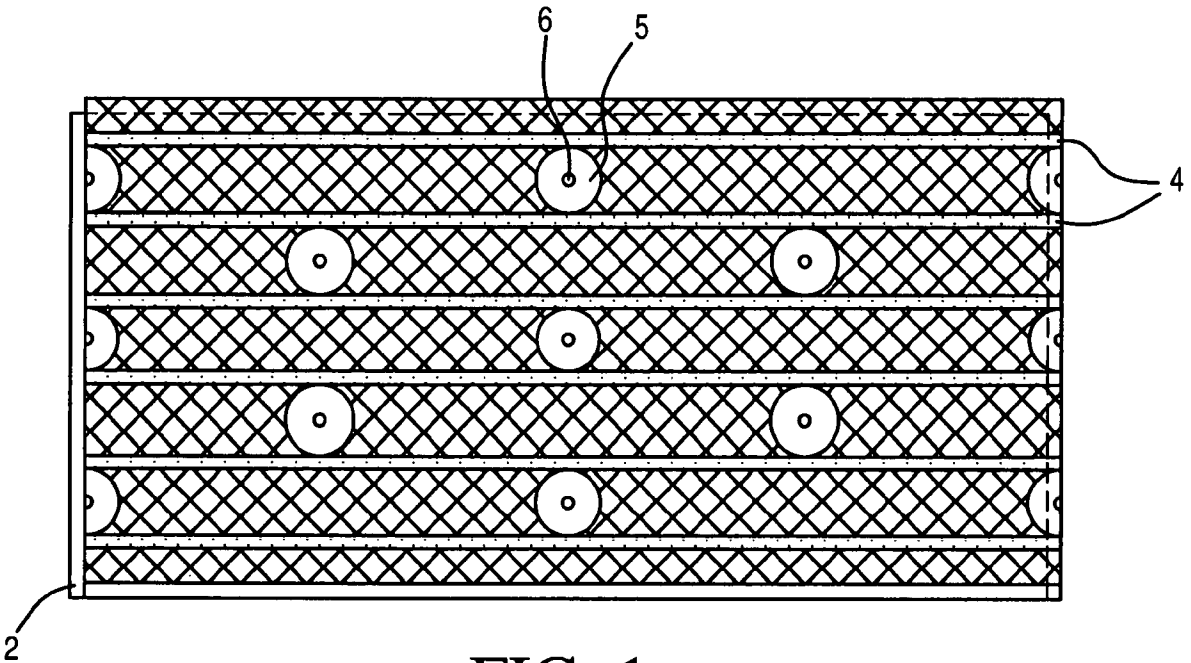
FIG. 1 shows the lining panel with insulation according to the invention with the front view.
Figure 3:
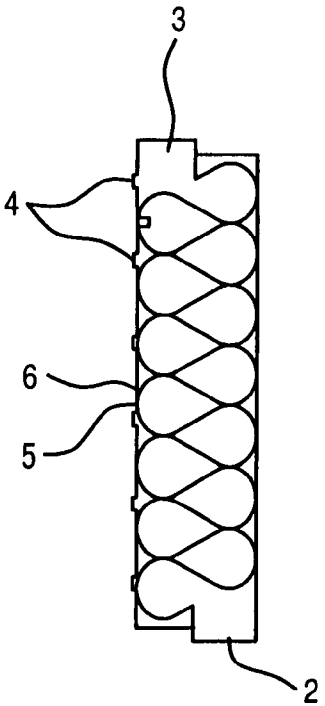
FIG. 3 shows the panel with the cross-section.

The lining panel with insulation according to the invention is a thin, cuboidal block 1 made of a porous insulation material with internal protruding elements 2 on two adjacent sides and frontal undercuts 3 on the remaining sides, and with parallel horizontal protruding elements 4 on the external surface. Yet, the distances between the two adjacent protruding elements 4 is a standardised width in ceramic tiles with two rows of multidirectional grooves. The surfaces between the protruding elements 4 contain round pressed forms 5 with width and thickness corresponding to edges of expansion bolts. In the centres, the forms contain deeper aligning pressed forms 6.

The panel according to the invention is made of a structural foam.

The panels according to the invention can be used for internal and external cladding of the walls since they combine insulating and decorative properties. The panels according to the invention allow for a quick, easy and clean fixing of ceramic tiles without using any additional spacers. They ensure good adhesive properties of both the lining panel with insulation and ceramic tiles. Pressed forms 5 and 6 on the panel facilitate fixing and force the fitters to follow fixing instructions.

The panels according to the invention are designed specifically to perform cladding made of ceramic clinker tiles. They speed up the fixing process as compared with the cladding with traditional methods.

The invention claimed is:

1. A lining panel having insulation adapted for fixing ceramic tiles thereto, the lining panel comprising:

a thin, cuboidal rigid block made of a porous insulation material, the block having four sides, internal protruding elements protruding from two adjacent sides and frontal undercuts being provided on each remaining side, the block having parallel horizontal protruding elements protruding upwardly from an external ceramic tile receiving surface, a distance between adjacent protruding elements being standardized to a width of the ceramic tiles locatable therebetween, the block having developed surfaces between the protruding elements (4), the developed surfaces surrounding round pressed forms evenly distributed in rows (5) on the block external surface, the round pressed forms having recessed dimensions sized to receive corresponding edges of expansion bolts locatable therein, centers of the rounded pressed forms containing deeper aligning pressed forms (6), such that when the expansion bolts are fixed within the pressed forms, there is provided an even adhesion of the lining panel to a base, and an even external surface for receiving the ceramic tiles between the protruding elements.

2. The lining panel according to claim 1, wherein the developed surfaces contain rows of parallel multidirectional grooves.

3. The lining panel according to claim 2, wherein the lining panel is made of an expanded polyurethane resin or of a rigid structural foam.

4. The lining panel according to claim 1 wherein the lining panel is made of an expanded polyurethane resin or of a rigid structural foam.

* * * * *